United States Patent [19]

Grasshoff

[11] 3,988,248

[45] Oct. 26, 1976

[54] LITHIUM SOAP LUBRICATING GREASE

[75] Inventor: Hans Dieter Grasshoff, Hamburg, Germany

[73] Assignee: Deutsche Texaco Aktiengesellschaft, Hamburg, Germany

[22] Filed: Mar. 17, 1975

[21] Appl. No.: 559,120

Related U.S. Application Data

[63] Continuation-in-part of Ser. No. 426,971, Dec. 20, 1973, abandoned.

[52] U.S. Cl. ..... 252/18; 252/25

[51] Int. Cl.[2] ..... C10M 3/18; C10M 5/14; C10M 7/20; C10M 7/24

[58] Field of Search ..... 252/18, 25

[56] References Cited

UNITED STATES PATENTS 3,758,407 9/1973 Harting ..... 252/18

*Primary Examiner*—Delbert E. Gantz
*Assistant Examiner*—I. Vaughn
*Attorney, Agent, or Firm*—T. H. Whaley; C. G. Ries; Kenneth R. Priem

[57] ABSTRACT

A grease which has improved stability at high temperature is provided by incorporating in an otherwise conventional grease a lithium soap of a hydroxy-stearic acid and an alkali borate. The grease is made by adding lithium tetraborate directly to a mixture comprising a lithium soap of a hydroxy-fatty acid and lubricating oil wherein the resulting mixture has from about 5 to 20 percent by weight of the lithium soap and from about 0.1 to 3 percent by weight of lithium tetraborate.

5 Claims, No Drawings

LITHIUM SOAP LUBRICATING GREASE

This is a continuation-in-part of application Ser. No. 426,971 filed Dec. 20, 1973 and now abandoned.

BACKGROUND OF THE INVENTION

1. Field of the Invention

The present invention relates to a lithium soap lubricating grease containing, in addition to the usual lubricating grease base and the customary lubricating grease additives, a thickening agent consisting of a lithium soap, preferably a lithium soap of a hydroxystearic acid and of an alkali borate.

2. Description of the Prior Art

In many applications, lubricating greases are superior to lubricating oils. They are employed, for example, to prevent the infiltration of harmful foreign matter by providing a barrier of grease, for example, in antifriction bearings or stuffing boxes. Greases are also employed to guarantee a very low need of lubricants, for example, on axle heads, in bearings with intermittent operation. Also, greases may be used to keep maintenance expenses low, for example, where bearing accessibility is difficult or in household appliance bearings. Greases are also preferred at points of lubrication with slow sliding movements, high pressures per unit area, and/or considerably varying loads.

Several different lubricating greases are in wide use, especially aluminum soap greases, calcium soap greases, sodium soap greases and lithium soap greases. Lithium soap greases have been employed in large scale for many years. The widely spread use of said lithium soap greases follows as a consequence of their combining all the essential advantages of calcium and sodium soap greases, i.e., they have excellent water-resistance, a low consistency at low temperatures, and upper service temperatures of above 100° C.

German Offenlegungsschrift 2 157 207 disclosed a process for producing lithium soap grease. The thickening system, necessary in addition to the lubricating oil, revealed 3 main components:

- a lithium soap of a hydroxy-fatty acid having from 12 to 24 carbon atoms;
- a lithium salt of a second hydroxy-fatty acid having from 3 to 14 carbon atoms; and
- the dilithium salt of a dicarboxylic acid having from 4 to 12 carbon atoms, and the dicarboxylic acid may, optionally, be replaced by monolithium salt of boric acid.

It has been shown, however, that in many cases the temperature stability of these greases is not sufficient, e.g., in lubricating the wheel bearings of some types of passenger cars. In cars equipped with disc brakes near the wheel bearings, bearing temperatures of from 180°–200° C were encountered while driving on mountain roads which required frequent braking. By using lithium soaps of the prior art, a risk of disk brake failure is run which is caused by the leakage of the grease out of the bearings.

Lubrication of hot air ventilator bearings is another example. Here, too, temperatures of from 150° to 200° C may be reached in the bearings. Lithium soap greases having a drop point of up to 200° C can no longer be used for lubricating these bearings.

U.S. Pat. No. 3,758,407 discloses a grease which is made by mixing together a fatty acid, lithium hydroxide and boric acid with heat. The resultant grease, however, possesses a dropping point below acceptable levels.

It is an object of this invention to produce a grease having a dropping point higher than has heretofore been possible.

SUMMARY OF THE INVENTION

The invention is a lithium soap lubricating grease made by adding lithium tetraborate directly to a mixture comprising a lithium soap of a hydroxy-fatty acid and lubricating oil wherein the resulting mixture has from about 5 to 20 percent by weight of the lithium soap and from about 0.1 to 3 percent by weight of lithium tetraborate. The invention is also a process for making lithium soap lubricating grease, the grease comprising lubricating oil and a lithium soap of a hydroxy-fatty acid present in an amount from about 5 to 20 percent by weight and from about 0.1 to 3 percent by weight of lithium tetraborate, the improvement which comprises adding the lithium tetraborate directly to the mixture.

DESCRIPTION OF THE PREFERRED EMBODIMENTS

It was found that the temperature stability of this improved lithium soap lubricating grease is considerably improved and results in a notably better stability to oxidative influences and in longer lasting lubricity. These properties which add to the quality of the novel grease of this invention may be attributed to the following:

a. employment of a long-chain hydroxy-fatty acid which is present as lithium salt in the final mixture, and b. incorporating minor amounts of alkali borate, preferably of a lithium tetraborate, directly into the said lubricating grease mixture as opposed to forming the alkali borate in situ during saponification.

A lubricating grease is obtained that melts only at temperatures above 200° C, preferably in the range of about 210° C to 300° C.

Usually, these lubricating greases are composed of three main components:

Liquid phase — base oil —
Thickener
Additives

Normally, the commercial lubricating greases contain naphthenic mineral oils, paraffinic oils, or also slightly refined oils. However, it is also common, especially when these lubricating greases are subjected to special stresses, to use synthetic fluids, such as polyalkyl glycols, ester oils produced from either dibasic acids and monovalent alcohols or from monobasic acids and polyvalent alcohols, silicon, halogenated hydrocarbons, or phenyl ether. For producing lubricating grease of the invention, it is preferred to use mineral oils and alkyl benzenes derived from the alkyl benzene synthesis.

Common prior art additives in the lubricating grease are active materials and tone-up agents. These active materials are, for instance, oxidation and corrosion inhibitors, lubricity improvers and extreme pressure additives. Colors and scents are added as tone-up agents to improve consumer appeal.

An essential factor of the invention is the thickener or thickening system which consists of a long-chain fatty acid, the alkali hydroxide, here lithium hydroxide, necessary for soap-forming, and of an alkali borate.

Hydroxy-fatty acids having from 10 to 30 carbon atoms are used as fatty acids. Preferred is the hydroxy-stearic acid wherein the hydroxyl-function may be in the 9-position, in the 10-position or the 12-position. Especially a 12-hydroxy-stearic acid may be used obtained from castor oil by means of cracking and hydrogenation and containing a minor amount of other fatty acids. Instead of the free hydroxy-fatty acid, also glyceride, e.g., 12-hydroxy-stearic, may be used. The utilization of hydroxy-stearic acids which are esterified with low alcohols, such as methanol, ethanol, isomeric propanols, or butanols, is to be considered a part of the invention.

Salts derived form the ortho- and metaboric acids which may also be present with crystal water, are employed as alkali borate. It has been shown that the advantageous properties of the novel lubricating grease are dependent primarily on the addition of lithium borate directly into the grease mixture as opposed to forming the lithium borate in situ during saponification. The lithium salt of tetraboric acid analog to borax is preferred, optionally in its crystal water-comprising modification.

From 5 to 20 percent by weight of lithium soap (based on the total lubricating grease batch) and from 0.1 to 3 percent by weight of alkali borate (also based on the total lubricating grease batch) in the thickener have proved to be sufficient. It is preferred to use from about 7.5 to 15 percent by weight of lithium soap and from about 0.15 to 0.75 percent by weight of lithium tetraborate.

Formulation, preparation, and properties of the novel lubricating grease are identified by the Examples below:

EXAMPLE 1

Charge:

10.0 kg 12-hydroxy-stearic acid
1.5 kg LiOH-monohydrate
0.5 kg $Li_2B_4O_7$
88.0 kg machine oil raffinate, 58cSt/50° C, naphthene-base Preparation In a suitable stirring vessel, 10.0 kg of 12-hydroxy-stearic acid were heated together with 25.0 kg of machine oil raffinate to a temperature of 85° C and subsequently saponified with 1.5 kg of LiOH-monohydrate dissolved in 10 liters of boiling water. During the dehydration at 100° C, 0.5 kg of $Li_2B_4O_7$ were added and, subsequent to the dehydration, the temperature of the vessel contents were increased to 240° C within 2 hours. While the mixture was heated, a further portion of the said machine oil (25 kg) was added thereto when the temperature was at 155° C. The remaining oil was added to the charge after reaching the maximum temperature of 240° C. Thereafter, the charge was cooled under stirring to a temperature of 60° C. At this temperature, the charge was homogenized by means of a corundum disc mill.

Result

A lubricating grease having a drop point of 265° C according to DIN Standard No. 51801, an unworked penetration of 272 mm/10, and a worked penetration (60 strokes) of 279 mm/10, as well as a worked penetration after 60,000 strokes of 305 mm/10 according to DIN Standard No. 51804 was thus obtained.

EXAMPLE 2

Charge:

10.00 kg 12-hydroxy-stearic acid methyl ester
1.55 kg LiOH-monohydrate
0.25 kg $Li_2B_4O_7$
50.00 kg alkyl benzene — last running, 50 cSt/50° C
38.20 kg cylinder oil, 30 cSt/100° C The mode of operation of Example 1 was repeated, thereby obtained a grease having the following properties:

| | |
|---|---|
| Drop point, DIN 51801, ° C | 274 |
| Unworked penetration, DIN 51804, mm/10 | 227 |
| Worked penetration, DIN 51804, 60 strokes mm/10 | 238 |
| Worked penetration, DIN 51804, 60,000 strokes mm/10 | 256 |

EXAMPLE 3

Charge:

12.50 kg 12-hydroxy-stearic acid methyl ester
1.84 kg LiOH-monohydrate
0.50 kg $Li_2B_4O_7$
1.00 kg phenyl-alpha-naphthylamine (oxidation inhibitor)
0.75 kg zinc-diamyldithiocarbamate (corrosion protection)
83.41 kg machine oil raffinate, 125 cSt/50° C.

Preparation 12.5 kg of 12-hydroxy-stearic acid methyl ester were saponified with 1.84 kg LiOH-monohydrate at a temperature of 80° C and in the presence of 50.0 kg machine oil raffinate. Subsequent to a raise in temperature to 115° C, 0.5 kg $Li_2B_4O_7$ were added. Thereafter, the charge was heated to a temperature of 245° C within 2.5 hours and, after the temperature had been reached, the charge was pumped to a stirring vessel equipped with water-cooling means for cold stirring. Here, at a temperature of 180° C, the remaining oil (33.41 kg), and, at a temperature of 98° C, the additives were added. After further cooling to 68° C while intensively stirring the charge was finally homogenized by means of a corundum disc mill and was de-aerated in a vacuum unit.

Result

| | |
|---|---|
| Drop Point, DIN 51808, ° C | 268 |
| Unworked penetration, DIN 51804,mm/10 | 219 |
| Worked penetration, DIN 51804, 60 strokes, mm/10 | 220 |
| Worked penetration, DIN 51804, 60,000 storkes mm/10 | 238 |

EXAMPLE 4 (Comparative Data)

Four greases were prepared exactly according to the procedure in column 3 of U.S. Pat. No. 3,758,407. The greases are identical to those in Table I of the patent. The designations A, 1, 2 and 3 are the same as those appearing in Table I of U.S. Pat. No. 3,758,407.

Grease A

A 5 kg batch of a grease, designated as "A", was prepared using as the thickener system a combination of lithium 12-hydroxy-stearate and monolithium borate. The base oil used in preparing this grease was a solvent-refined Solvent 30 Neutral lube oil having a viscosity at 100° F of about 520 SUS 496 gr. 12-hydrostearic acid was added to 2100 gr. of the base oil (about ½ of the total oil used in the complete grease) and the mixture was heated to a temperature sufficiently high to melt the 12-hydrostearic acid, this temperature being about 185° F. Then 82 gr. boric acid and 125 gr.

lithium hydroxide monohydrate were added as an aqueous solution, and the resulting mixture was stirred and heated to a final temperature of about 383° F. Then the remaining portion, 2197 gr., of the base oil was added and the mixture was cooled to ambient temperature and milled in a conventional grease unit.

Grease 1

A 5 kg batch of grease was made exactly like A but omitting the boric acid.

Grease 2 and 3

Two additional 5 kg batches of grease were prepared. In each case the same proportion of 12-hydroxy-stearic acid and boric acid as in the grease A but increasing the amount of lithium hydroxide monohydrate so as to form dilithium borate (Grease 2) and trilithium borate (Grease 3) instead of monolithium borate (Grease A).

Each of the greases thus prepared was measured for dropping point and ASTM penetration at 77° F. The composition of the greases (by weight percent) and the properties are shown in Table I. Three greases were prepared exactly according to the description of grease preparation in Examples 1–3 above and the results are shown in Table II.

The results demonstrated that the grease of U.S. Pat. No. 3,758,407 at Table I, Comparative Grease 2, has a lower dropping point than the grease of my invention as shown in Table II attached.

I claim:

1. A lithium soap lubricating grease comprising 5 to 20 percent by weight of a lithium soap of a hydroxy fatty acid having 10 to 30 carbon atoms, 0.1 to 3 percent by weight of lithium tetraborate, and the remainder of lubricating oil, made by a process comprising:

admixing lithium soap and a mojor amount of the base oil;

dehydrating;

adding lithium tetraborate;

heating to a higher temperature of about 240° C.;

adding the remaining portion of the base oil;

cooling; and homogenizing.

2. A process of claim 1 wherein the lithium soap is the lithium soap of a hydroxy-stearic acid.

3. A process of claim 1 containing the lithium soap of the previously esterified 12-hydroxystearic acid.

4. A process of claim 1 containing the lithium soap of 12-hydroxystearic acid which has previously been exterified with methyl alcohol, ethyl alcohol, propyl alcohol, butyl alcohol or glycerine.

5. A process of claim 1 wherein the grease comprises from 7.5 to 15 weight percent of lithium soap and from 0.15 to 0.75 weight percent of lithium tetraborate.

* * * * *

TABLE I

| | Test Runs According to U.S. 3,758,407 | | | | | | | | |
|---|---|---|---|---|---|---|---|---|---|
| | | | | Comparative Greases | | | | | |
| | Grease A | | | 1 | | 2 | | 3 | |
| Charge No.*) | 221392 | 221438 | 221787 | 221393 | 221788 | 221391 | 221789 | 221394 | 221790 |
| 12-hydroxy-stearic acid | 9.92 | 9.92 | 9.92 | 10.2 | 10.2 | 9.83 | 9.83 | 9.7 | 9.7 |
| $LiOH \cdot H_2O$ | 2.5 | 2.5 | 2.5 | 1.42 | 1.42 | 3.38 | 3.38 | 4.7 | 4.7 |
| boric acid | 1.64 | 1.64 | 1.64 | — | — | 1.63 | 1.63 | 1.61 | 1.61 |
| base oil | 85.93 | 85.93 | 85.93 | 88.36 | 88.36 | 85.15 | 85.15 | 84.07 | 84.07 |
| Properties: | | | | | | | | | |
| Dropping point, ° C | 223 | 215 | 236 | 201 | 209 | 218 | 209 | 252 | 220 |
| ASTM penetration at 25° C and 60 strokes | 295 | 292 | 226 | 286 | 255 | 218 | 255 | 278 | 234 |

*)weight percent

TABLE II

| | Test Runs According to Examples 1–3 | | | | | | |
|---|---|---|---|---|---|---|---|
| | Example | | | | Properties | | |
| | 1 | 2 | 3 | | 1 | 2 | 3 |
| Charge No.*) | 221799 | 221800 | 221801 | dropping point ° C | 250 | 240 | 274 |
| 12-hydroxystearic acid | 10 | — | — | unworked penetration | 218 | 223 | 269 |
| 12-hydroxystearic methylester | — | 10 | 12,50 | worked penetration | 221 | 238 | 286 |
| $LiOH \cdot H_2O$ | 1,5 | 1,55 | 1,84 | | | | |
| $Li_2B_4O_7$ | 0,5 | 0,25 | 0.50 | | | | |
| base oil | 88,0 | 88,20 | 85,16 | | | | |

*)weight percent